US007355609B1

(12) United States Patent
Voas et al.

(10) Patent No.: US 7,355,609 B1
(45) Date of Patent: Apr. 8, 2008

(54) COMPUTING VISIBLE REGIONS FOR A HIERARCHICAL VIEW

(75) Inventors: Ed Voas, Sunnyvale, CA (US); Guyerik B. Fullerton, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 117 days.

(21) Appl. No.: 10/213,929

(22) Filed: Aug. 6, 2002

(51) Int. Cl.
*G09G 5/00* (2006.01)

(52) U.S. Cl. ..... 345/629

(58) Field of Classification Search ..... 345/421, 345/422, 592, 619–630, 645, 713, 759, 766, 345/768, 781–783, 788, 790–797, 803, 806, 345/853, FOR. 206
See application file for complete search history.

(56) References Cited

U.S. PATENT DOCUMENTS

| | | | | |
|---|---|---|---|---|
| 5,430,496 | A * | 7/1995 | Silverbrook | 348/589 |
| 5,949,432 | A | 9/1999 | Gough et al. | 345/435 |
| 5,973,702 | A * | 10/1999 | Orton et al. | 345/619 |
| 6,072,489 | A | 6/2000 | Gough et al. | 345/345 |
| 6,202,096 | B1 * | 3/2001 | Williams et al. | 709/230 |
| 6,369,830 | B1 | 4/2002 | Brunner et al. | 345/629 |
| 6,456,285 | B2 * | 9/2002 | Hayhurst | 345/422 |
| 6,483,519 | B1 * | 11/2002 | Long et al. | 345/619 |
| 6,515,675 | B1 * | 2/2003 | Bourdev | 345/629 |
| 6,636,245 | B1 * | 10/2003 | Estipona | 715/790 |
| 6,670,970 | B1 * | 12/2003 | Bonura et al. | 715/768 |
| 6,801,230 | B2 * | 10/2004 | Driskell | 715/854 |
| 7,136,064 | B2 * | 11/2006 | Zuiderveld | 345/424 |
| 2001/0012018 | A1 * | 8/2001 | Hayhurst | 345/630 |
| 2004/0257384 | A1 * | 12/2004 | Park et al. | 345/646 |

OTHER PUBLICATIONS

Thomas Chester and Richard Alden, Mastering Excel 97, 1997, Sybex, Fourth Edition, pp. 6, 35, and 44-45.*
Robert Cowart, Mastering Windows 3.1, 1993, Sybex, Special Edition, pp. 66-67.*

* cited by examiner

*Primary Examiner*—Matthew C. Bella
*Assistant Examiner*—Greg F. Cunningham
(74) *Attorney, Agent, or Firm*—Schwegman, Lundberg & Woessner, P.A.

(57) ABSTRACT

A method, apparatus, system, and signal-bearing medium that in an embodiment determines the visible regions of potentially overlapping views and writes the visible regions to an output device. The visible regions may be determined using the visible-above region associated with a view. The views may have child, parent, and sibling views. A view may be any object capable of being displayed. In this way, the number of times that a pixel is written to the output device is reduced.

15 Claims, 16 Drawing Sheets

COMPUTING VISIBLE REGIONS FOR A HIERARCHICAL VIEW

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever.

FIELD

This invention relates generally to display systems and more particularly to display systems utilizing graphical user interfaces.

BACKGROUND

Existing display systems are capable of making a composite of two or more display elements to generate a final image. In such systems, display elements often include overlapping layers, for example in a windowing system for a graphical user interface where on-screen elements, such as windows, may be moved around and placed on top of one another.

Rendering and displaying an image having two or more overlapping layers presents certain problems, particularly in determining how to render that portion of the image where the layers overlap. When the overlapping layers are opaque, the graphics system need only determine which layer is on top, and display the relevant portion of that layer in the final image, and portions of underlying layers that are obscured may be ignored. However, when overlapping layers are translucent, more complex processing may be called for, as some interaction among picture elements (pixels) in each overlapping layer may take place. Accordingly, some calculation may be required to overlay the image elements in order to derive a final image.

Step-by-step compositing techniques for performing these calculations require a number of separate operations in order to generate the final image. This is generally accomplished by forming the composite of image elements in a bottom-up approach, successively combining each new layer with the results of the compositing operations performed for the layers below.

This step-by-step compositing approach has several disadvantages. If the image is constructed in the frame buffer, on-screen flicker may result as the system writes to the frame buffer several times in succession. Alternatively, the image may be constructed in an off-screen buffer, thus avoiding on-screen flicker; however, such a technique requires additional memory to be allocated for the buffer, and also requires additional memory reads and writes as the final image is transferred to the frame buffer.

In addition, step-by-step generation of the final image may result in poor performance due to the large number of arithmetic operations that must be performed. Writing data to a frame buffer is particularly slow on many computers; therefore, conventional systems which write several layers to the frame buffer in succession face a particularly severe performance penalty.

Finally, such a technique often results in unnecessary generation of some portions of image elements that may later be obscured by other image elements, which results in poor performance.

SUMMARY

A method, apparatus, system, and signal-bearing medium are provided that in an embodiment determines the visible regions of potentially overlapping views and writes the visible regions to an output device. The visible regions may be determined using the visible-above region associated with a view. The views may have child, parent, and sibling views. A view may be any object capable of being displayed. In this way, the number of times that a pixel is written to the output device is reduced.

DETAILED DESCRIPTION

In the following detailed description of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known circuits, structures, and techniques have not been shown in detail in order not to obscure the invention.

Figure 1A:
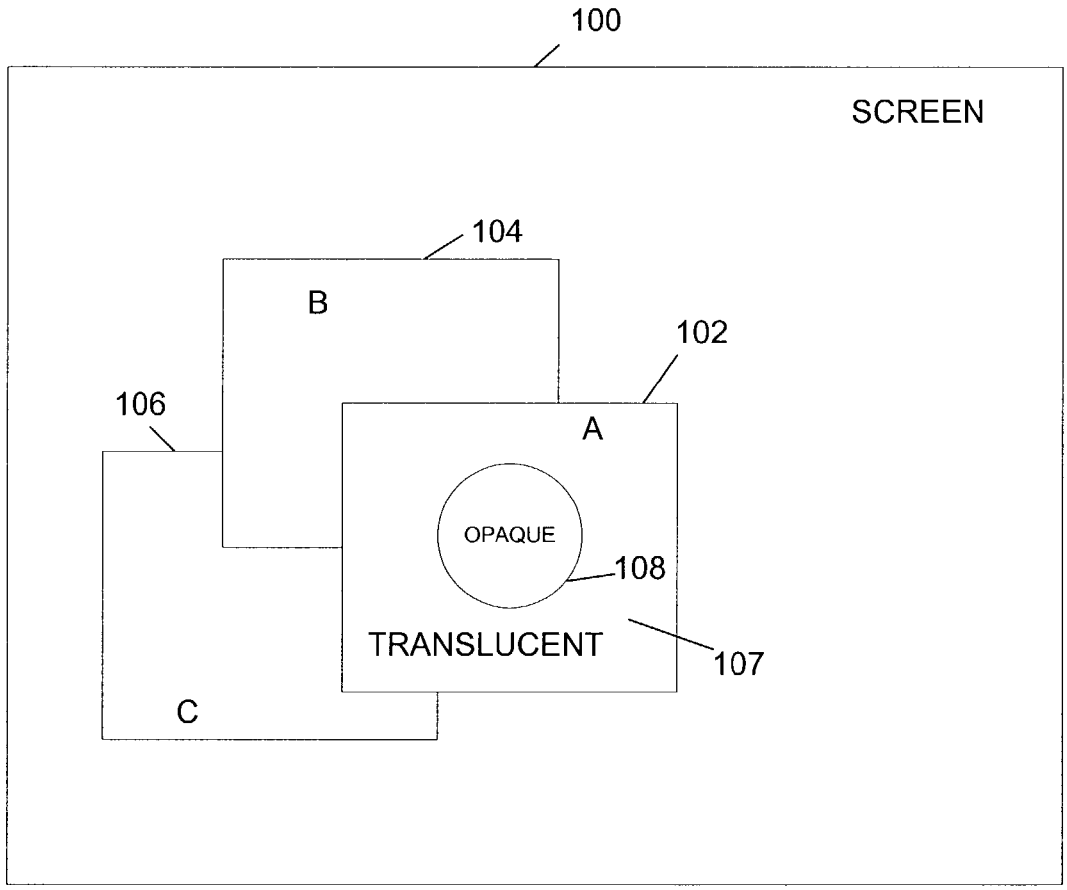
FIG. 1A depicts a pictorial representation of views on a screen, according to an embodiment of the invention.

FIG. 1A depicts a pictorial representation of views on a screen, according to an embodiment of the invention. Screen 100 includes view A 102, view B 104, and view C 106. View A 102 includes a translucent region 107 and an opaque region 108. The respective portions of the view B 104 and the view C 106 may be partially visible through the translucent region 107 of the view A 102, but are not visible through the opaque region 108. A view may be a window, a button, a slider, a menu, a dial, and icon, or any other type of displayable object or region on a display screen.

FIGS. 1B, 1C, 1D, and 1E depict block diagrams illustrating intermediate results of example processing for rendering the various views previously described above with reference to FIG. 1A, according to an embodiment of the invention.

Figure 1B:
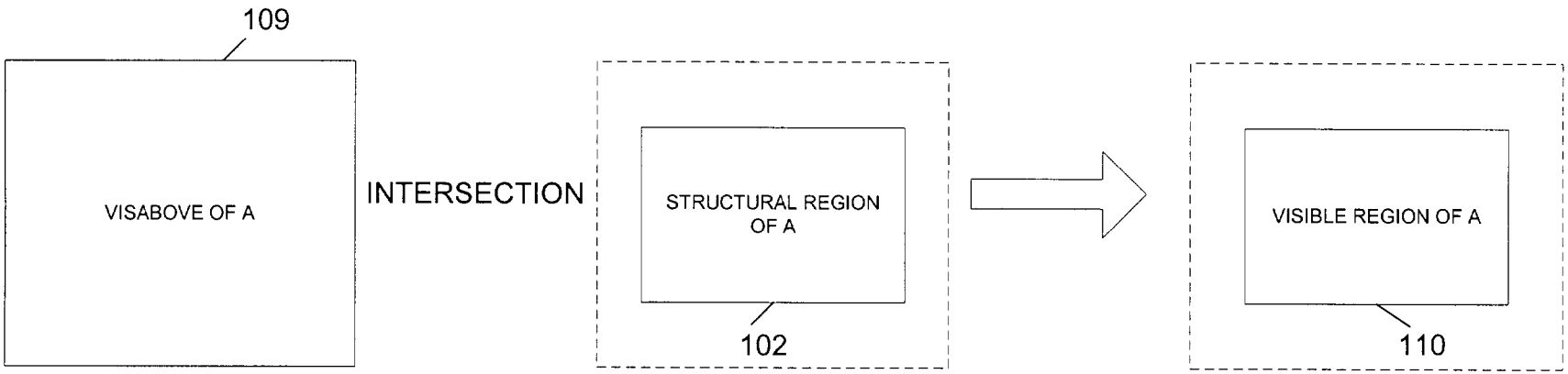
FIGS. 1B, 1C, 1D, and 1E depict block diagrams illustrating intermediate results of example processing, according to an embodiment of the invention.

FIG. 1B depicts an operation that intersects the visabove of A 109 with the structural region of A 102 to form the visible region of A 110. A visabove (visible-above region) is the area on the screen above a view that the view can been seen through. A structural region of a view represents everything that might possibly be drawn on the screen, ignoring any opaque view or views that might be above the structural region. In this example, the visabove of A 109 happens to be identical to the screen 100 shown in FIG. 1A because the view A 102 is the topmost view. Since FIG. 1B shows the structural region of A 102 intersecting with the visabove of A 109, which happens to be the screen 100, the visible region of A 110 happens to be equal to the structural region of A 102 in this example, but in the general case this may not necessarily be true. The visible region of A 110 is now ready to be written to the screen, but in another embodiment it may be saved until later, e.g., when the entire screen (every pixel) may be written at once.

Figure 1C:
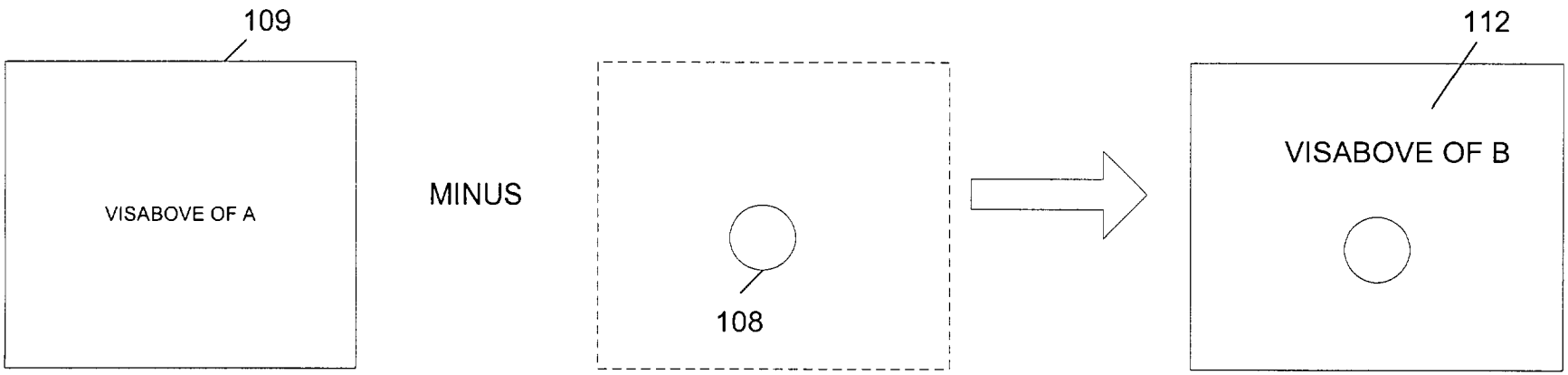

FIG. 1C depicts an operation that subtracts the opaque region 108 of view A from the visabove of A 109 to yield the visabove of the next front-most view 112, which in this example happens to be the visabove of B. Notice that the visabove of B 112 does not include the opaque region 108; instead the opaque region 108 (FIG. 1A) is punched out of the visabove of B 112.

Figure 1D:
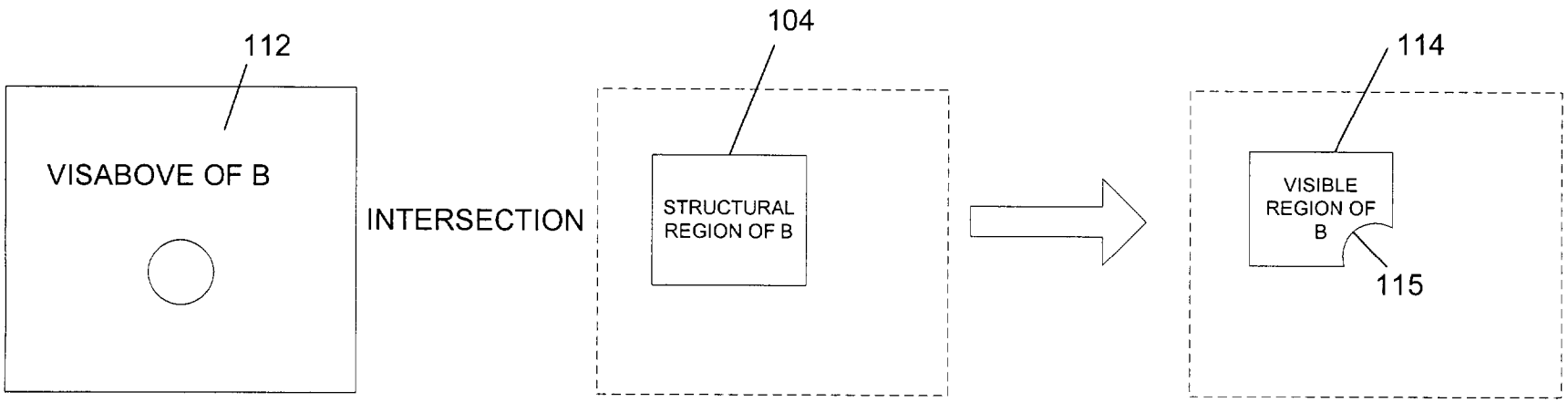

FIG. 1D depicts an operation that intersects the visabove of B 112 with the structural region of B 104 to yield the visible region of B 114. Notice that the visible region of B 114 has a rounded corner 115, indicating that the opaque region 108 (FIG. 1A) has been punched out of the visible region of B 114. The visible region of B 114 is now ready to be written to the screen.

Figure 1E:
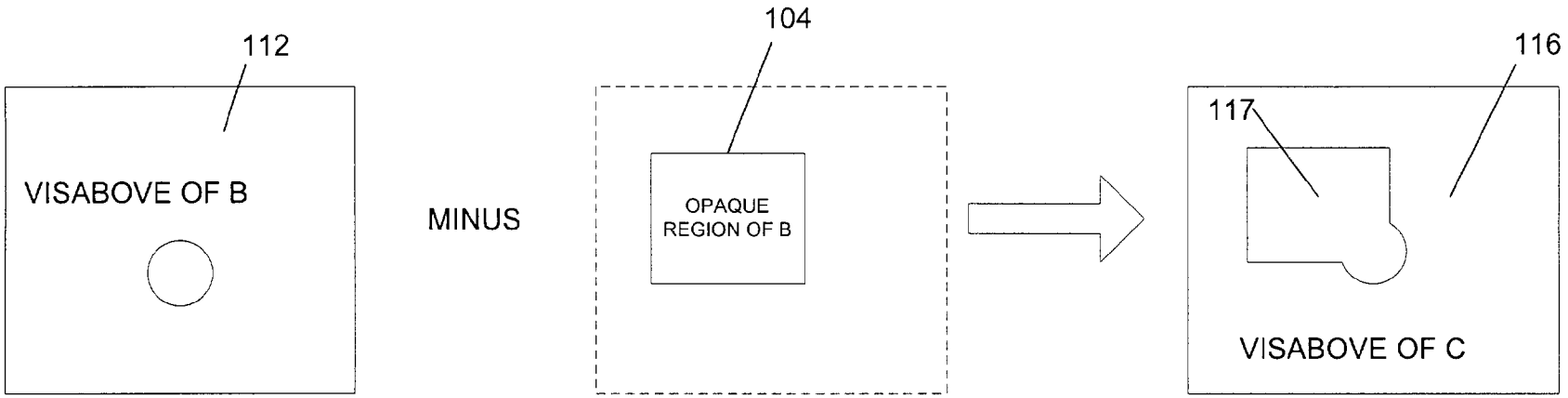

FIG. 1E depicts an operation that subtracts the opaque region of B 104 from the visabove of B 112 to yield the visabove of the next front-most view 116, which in this example is the visabove of C 116. Notice that the visabove of C 116 has an area 117 punched out of the visabove of C 116 equal to the opaque region of B 104 unioned with the opaque region 108 (FIG. 1A).

The visible portions of the remaining views may now be calculated in a manner analogous to those already described in FIGS. 1B, 1C, 1D, and 1E. By calculating the visible portion of the views using the above described visabove technique, every opaque pixel on the screen may be written only once, despite having multiple overlapping views.

Figure 2A:
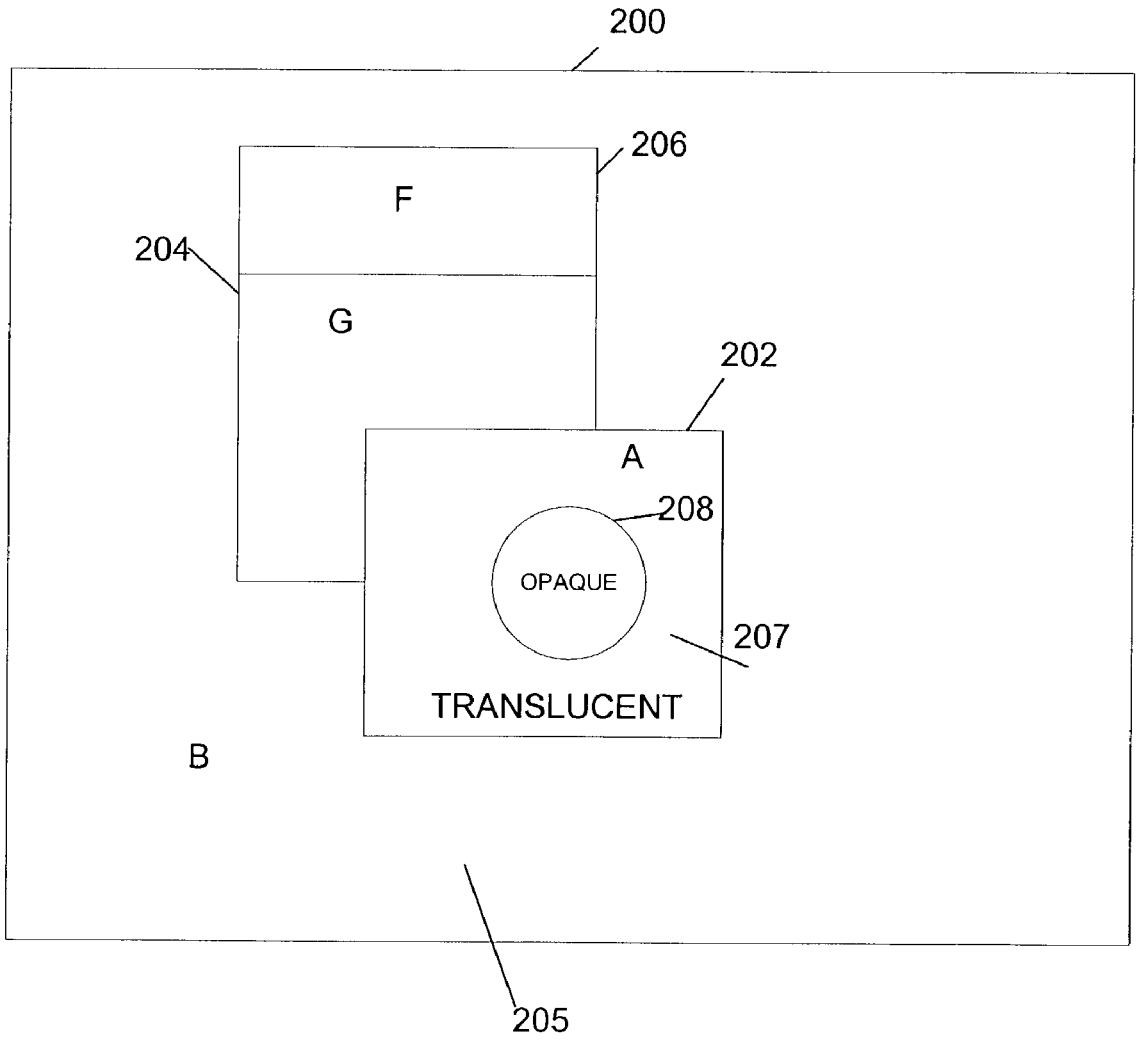
FIG. 2A depicts a pictorial representation of views on a screen where the views have siblings, according to an embodiment of the invention.

FIG. 2A depicts a pictorial representation of views on a screen where the views may have children, according to an embodiment of the invention. Screen 200 includes view A 202, view G 204, view B 205, and view F 206. View A 202 has an opaque region 208 and a translucent region 207.

Views may be arranged in a hierarchy. At the top of the hierarchy is a root view, which covers the display screen. The root view is partially or completely covered by its child views, and the root view is the parent of its child views. All views, except for root views, have parents. Child views may have their own children. A child view that shares the same parent view as one or more other child views is called a sibling view. Views G 204 and F 206 are sibling views.

FIGS. 2B, 2C, 2D, 2E, and 2F depict block diagrams illustrating intermediate results of example processing for handling parent, child, and sibling views, according to an embodiment of the invention.

Figure 2B:
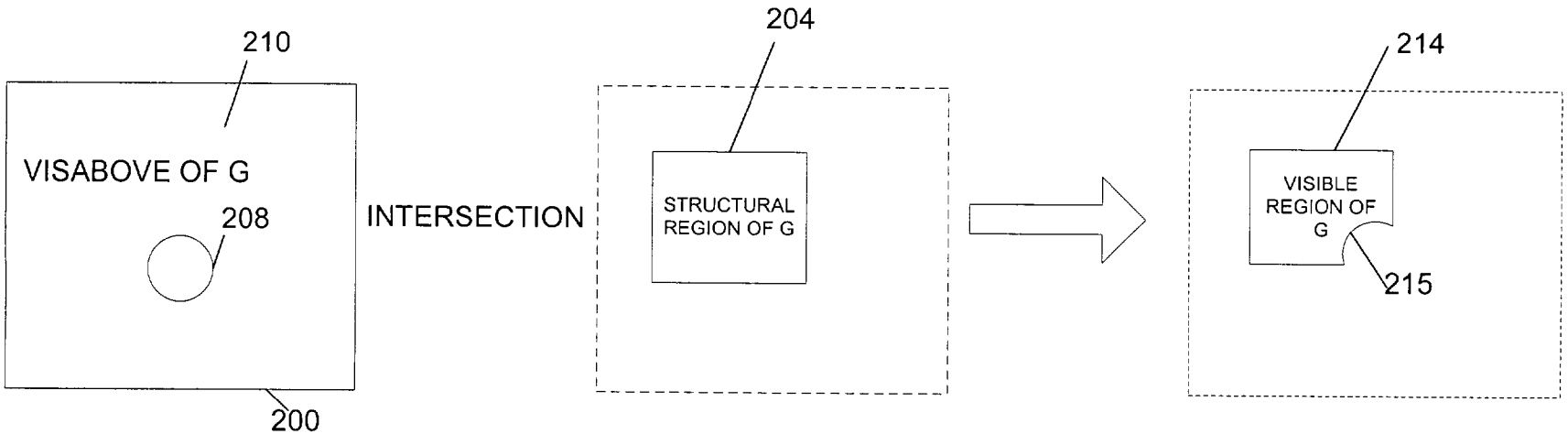
FIGS. 2B, 2C, 2D, 2E, and 2F depict block diagrams illustrating intermediate results of example processing, according to an embodiment of the invention.

FIG. 2B depicts an operation that intersects the visabove of G 210 with the structural region of G 204 to yield the visible region of G 214. Notice that the visible region of G 214 has a rounded corner 215, indicating that the opaque region 208 (FIG. 2A) has been punched out of the visible region of G 214. Notice also that the opaque region 208 is punched out of the visabove of G 210. The visible region of G 214 is now ready to be written to the screen, although in another embodiment it may be saved until later, e.g., when the entire screen (all pixels) may be written at once.

Figure 2C:
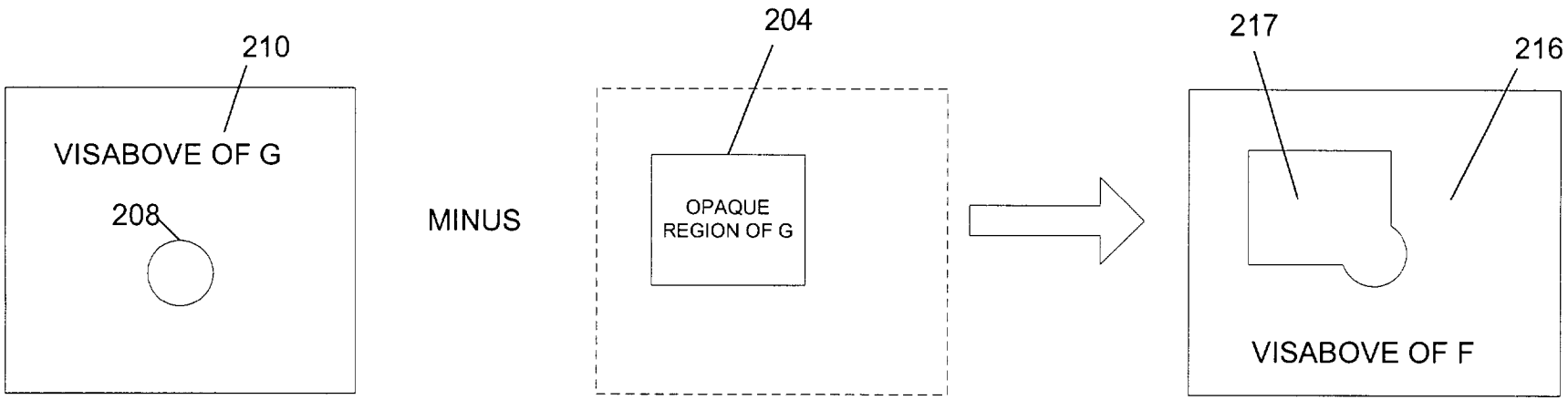

FIG. 2C depicts an operation that subtracts the opaque region of G 204 from the visabove of G 210 to yield the visabove of F 216. Notice that the visabove of F 216 has an area 217 punched out of it equal to the opaque region of G 204 unioned with the opaque region 208 (FIG. 2A).

Figure 2D:
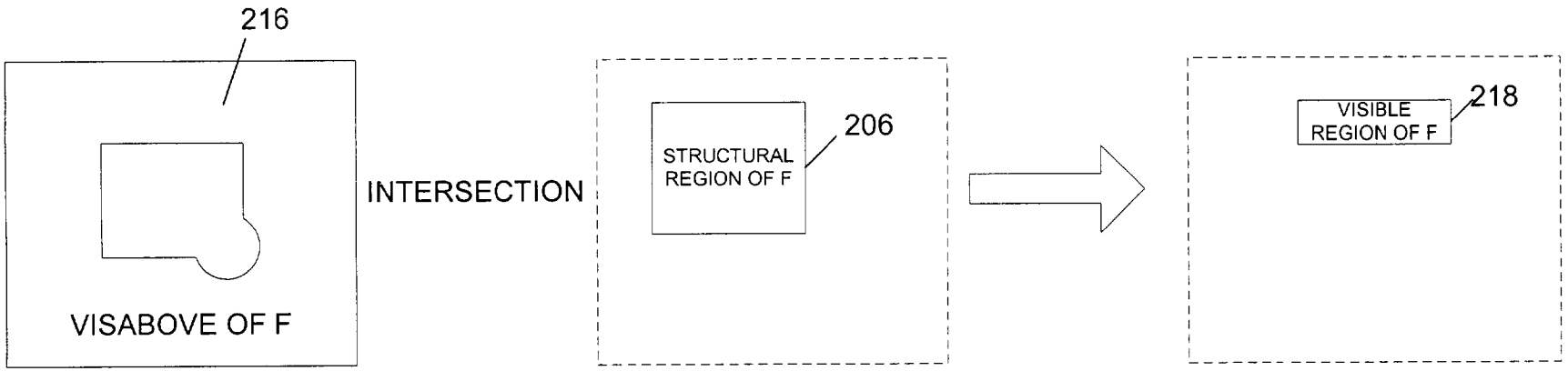

FIG. 2D depicts an operation that intersects the visabove of F 216 (previously determined in FIG. 2C) with the structural region of F 206 to yield the visible region of F 218. The visible region of F 218 is now ready to be written to the screen, although in another embodiment it may be saved until later, e.g., when the entire screen (all pixels) is written at once.

Figure 2E:
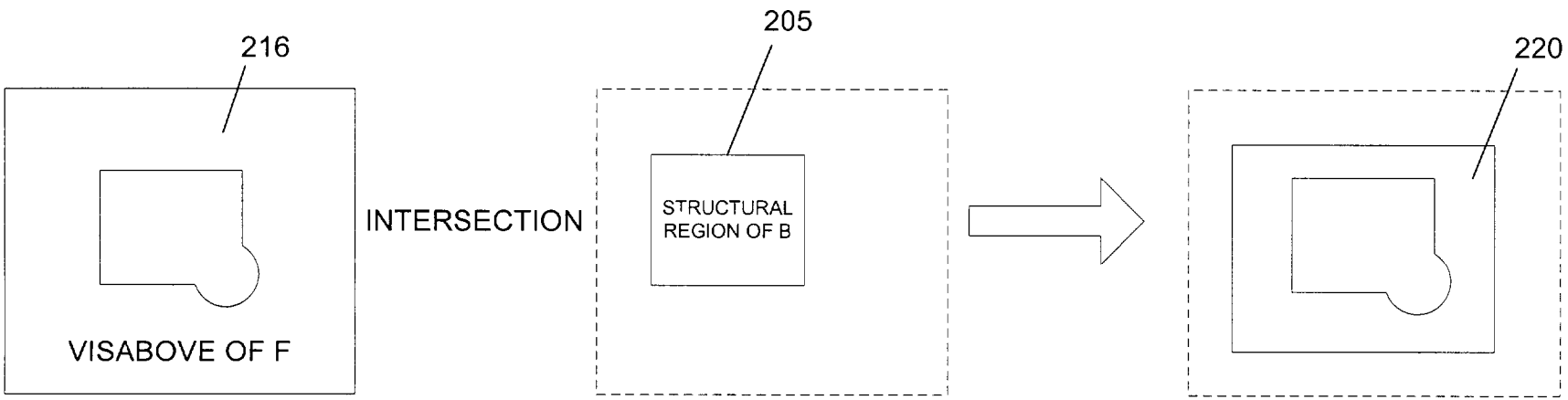

FIG. 2E depicts an operation that intersects the visabove of F 216 with the structural region of B 205 to yield the visible region of B 220. The visible region of B 220 is now ready to be written to the screen, although in another embodiment it may be saved until later.

Figure 2F:
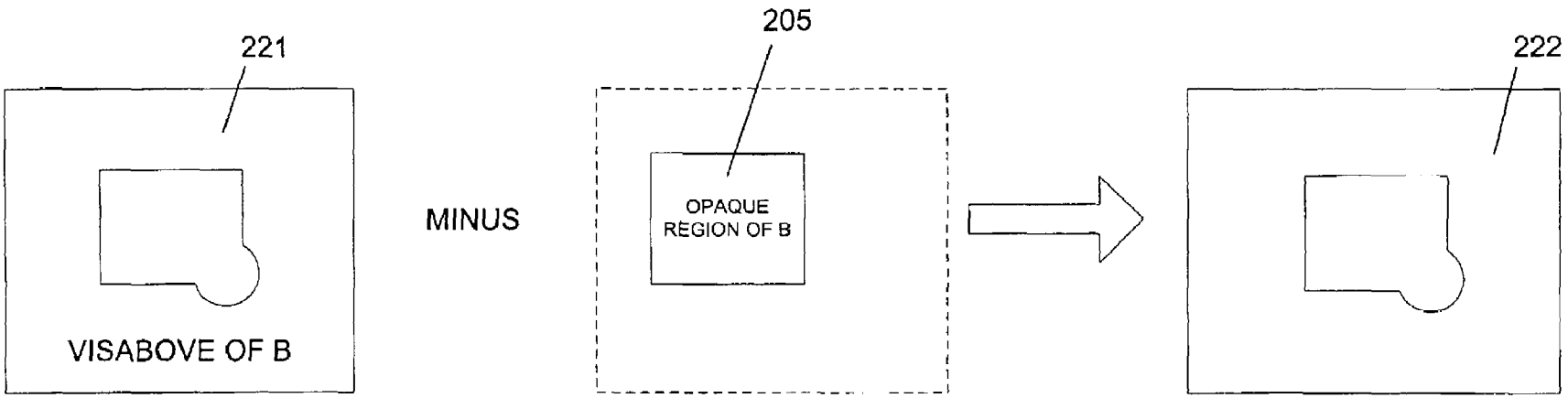

FIG. 2F depicts an operation that subtracts the opaque region of B 205 from the visabove of B 221 to yield the visabove 222 to pass to the sibling of B.

Figure 3:
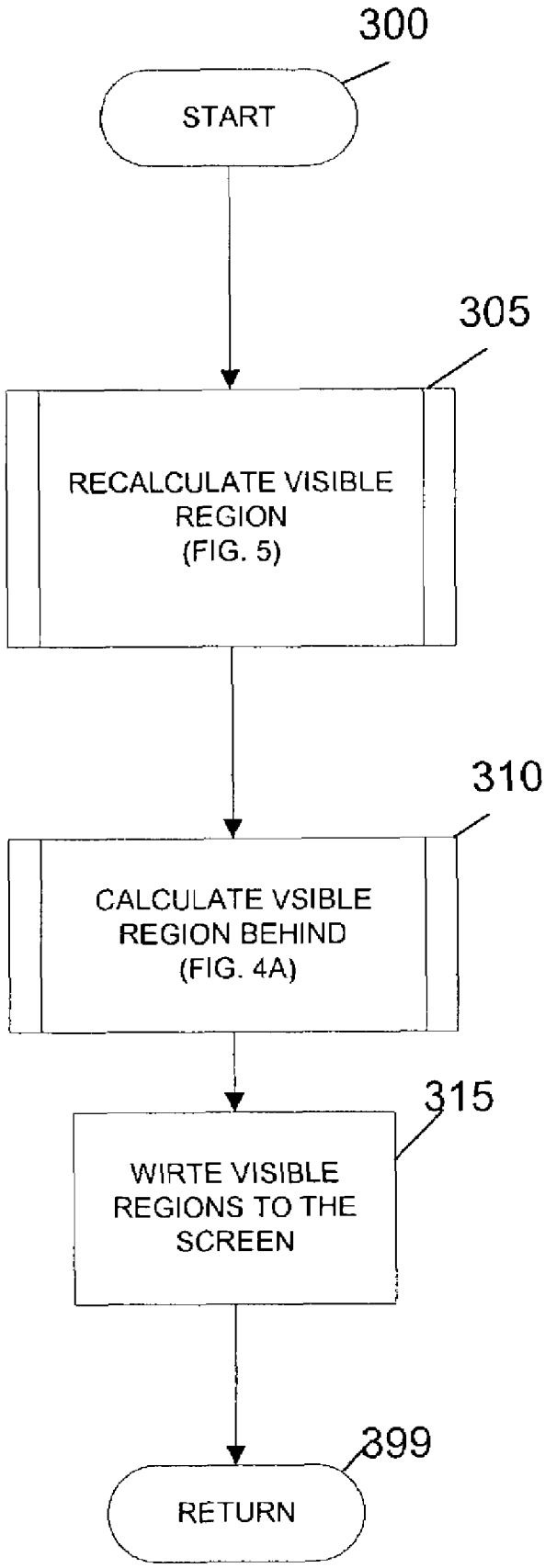
FIG. 3 depicts a flowchart of example processing for a recalculate visible region and propagate function, according to an embodiment of the invention.

FIG. 3 depicts a flowchart of example processing for a recalculate visible region and propagate function, according to an embodiment of the invention. The processing of FIG. 3 may be called when a view is moved on an output device or when a new view is to be written to an output device.

Control begins at block 300. Control then continues to block 305 where the recalculate visible region function is invoked, as further described below with reference to FIG. 5. Control then continues to block 310 where the calculate visible region behind function is invoked, as further described below with reference to FIG. 4A. Control then continues to block 315 where the regions may be written to the screen after all the visible regions have been calculated. Control then continues to block 399 where the function returns.

Figure 4A:
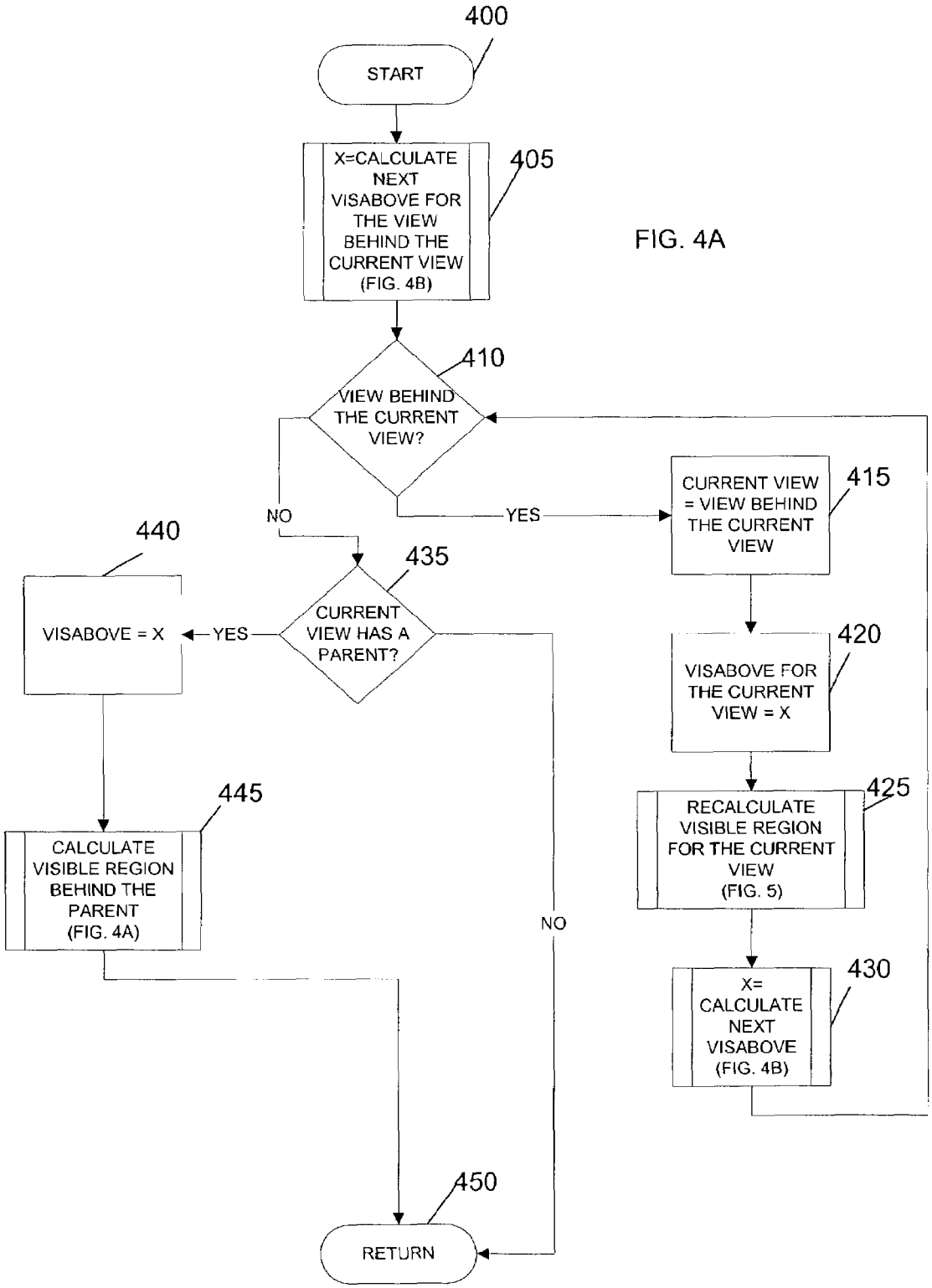
FIG. 4A depicts a flowchart of example processing for a calculate visible region behind function, according to an embodiment of the invention.
Figure 4B:
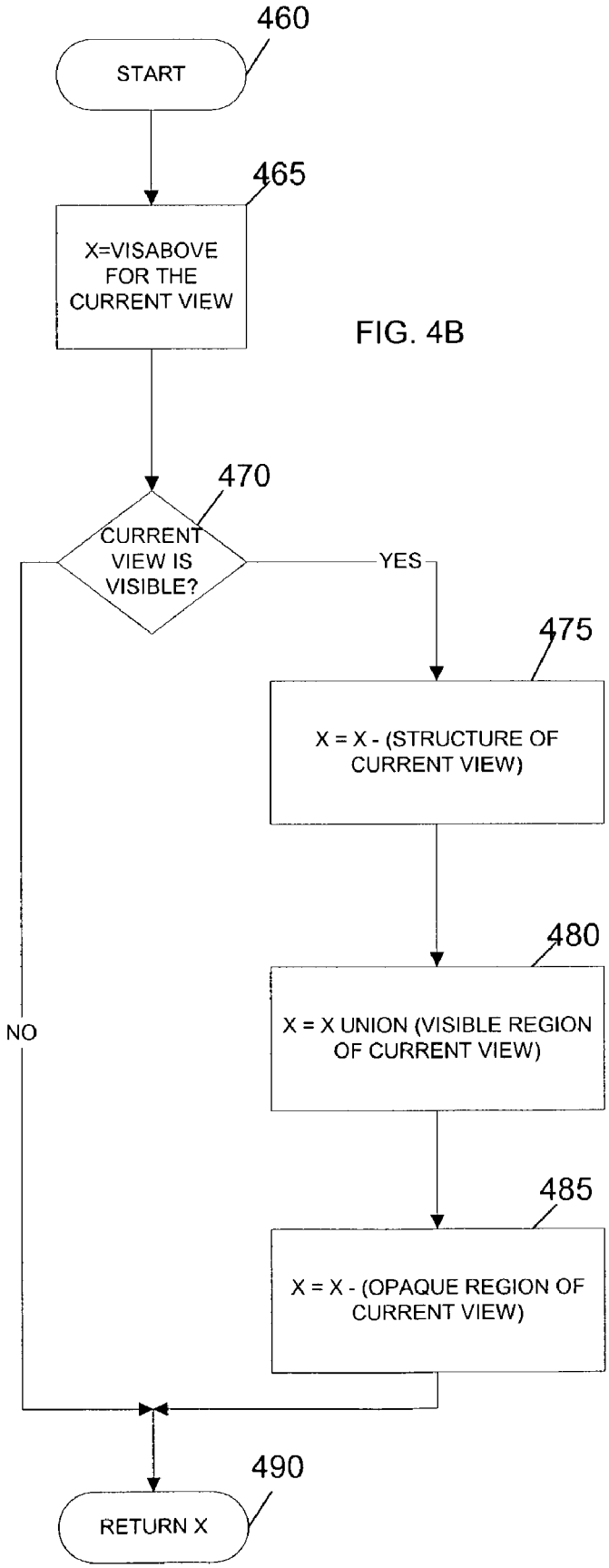
FIG. 4B depicts a flowchart of example processing for a calculate next visible region above function, according to an embodiment of the invention.

FIG. 4A depicts a flowchart of example processing for a calculate visible region behind function, according to an embodiment of the invention. Control begins at block 400. An identification of the current view may be passed into the function of FIG. 4A. Control then continues to block 405 where the visabove for the view behind the current view is calculated, as further described below with reference to FIG. 4B. The value returned from the function of FIG. 4B is set to x, which in an embodiment may be a temporary variable used to store intermediate results during the processing of FIG. 4A, but in other embodiments, any appropriate variable, register, temporary storage, or permanent storage may be used.

Control then continues to block 410 where it is determined whether a view exists behind the current view. If the determination at block 410 is true, then control continues to block 415 where the current view is set to be the view behind the current view. Control then continues to block 420 where the visabove for the current view is set to be x. Control then continues to block 425 where the visible region for the current view is recalculated, as further described below with reference to FIG. 5. Control then continues to block 430 where x is set to be the returned value from the calculate next visabove function, which is further described below with reference to FIG. 4B. Control then returns to block 410, as previously described above.

If the determination at block 410 is false, then control continues to block 435 where it is determined whether the current view has a parent view. If the determination at block 435 is true, then control continues to block 440 where the visabove of the current view is set to be x. Control then continues to block 445 where the visible region behind the parent is calculated via a recursive call to the function of FIG. 4A. Control then continues to block 450 where the function returns.

If the determination at block 435 is false, then control continues directly to block 450 where the function returns.

If the determination at block 405 is true, then control continues to block 410 where the recalculate and propagate function is called to process the view behind the current view, as previously described above with reference to FIG. 3. Control then continues to block 499 where the function returns.

FIG. 4B depicts a flowchart of example processing for a calculate next visible region above function, according to an embodiment of the invention. Control begins at block 460. Control then continues to block 465 where the variable x is set to be the visabove for the current view. Control then continues to block 470 where it is determined whether the current view is visible.

If the determination at block 470 is true, then control continues to block 475 where x is set to be x minus the structure of the current view. Control then continues to block 480 where the union of x with the visible region of the current view is performed and the result is set to x. Control then continues to block 485 where the opaque region of the current view is subtracted from x and the result is set to x. Control then continues to block 490 where the function returns the value of x.

If the determination at block 470 is false, then control continues directly to block 490 where the function returns the value of x.

Figure 5:
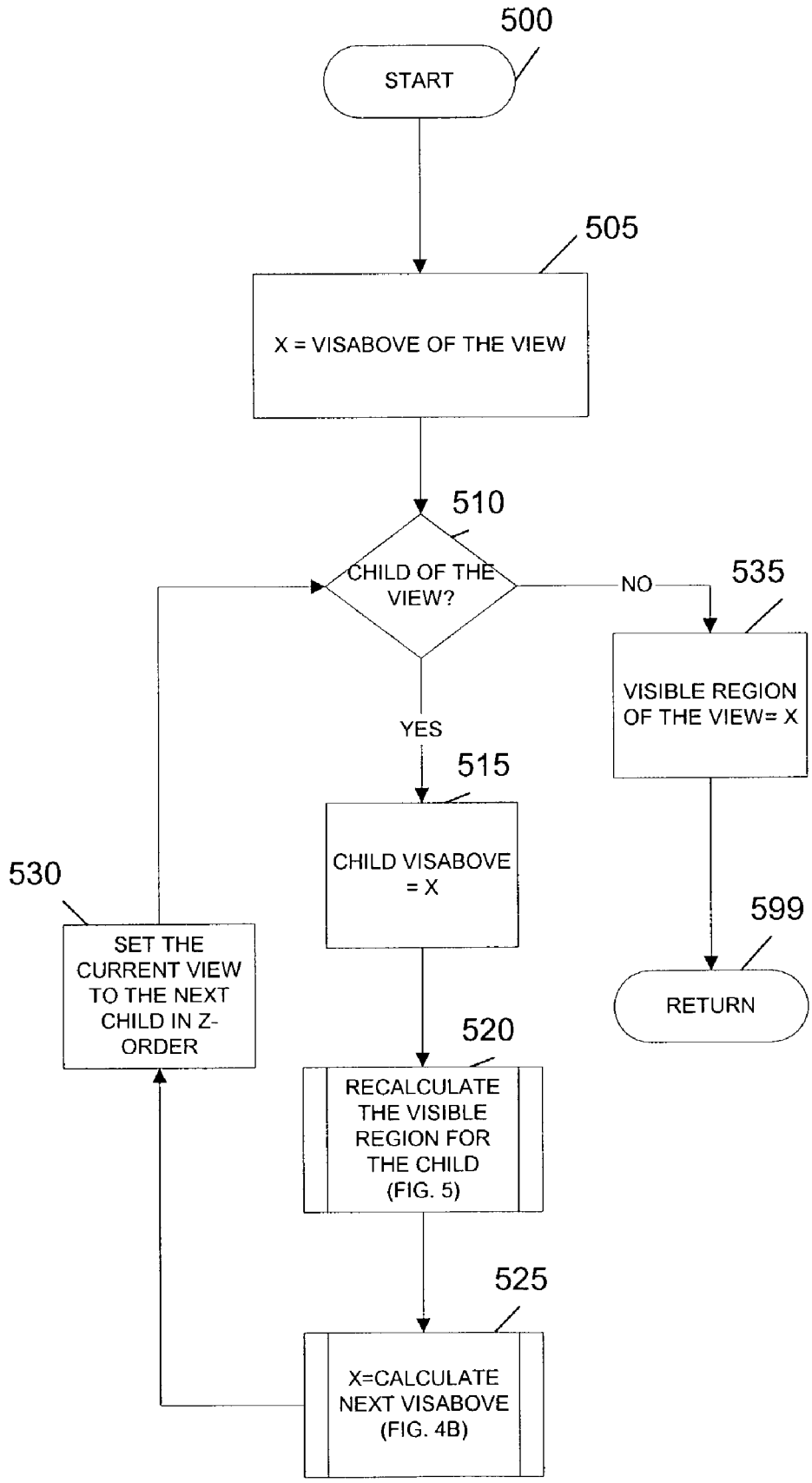
FIG. 5 depicts a flowchart of example processing for a recalculate visible region function, according to an embodiment of the invention.

FIG. 5 depicts a flowchart of example processing for a recalculate visible region function, according to an embodiment of the invention. Control begins at block 500. An indication of the view to be processed may be passed as a parameter into the function of FIG. 5. Control then continues to block 505 where the visabove of the passed-in view is stored in a variable, which in an embodiment is denominated as x. The variable x may be a temporary variable used to store intermediate results during the processing of FIG. 5, but in other embodiments, any appropriate variable, register, temporary storage, or permanent storage may be used. Control then continues to block 510 where a determination is made whether a child of the view exists.

If the determination at block 510 is true, then control continues to block 515 where the visabove of the child is set to be x. Control then continues to block 520 where the function of FIG. 5 is recursively called to recalculate the visible region of the child. Control then continues to block 525 where the variable x is set to be the result returned from the calculate next visabove function, as previously described above with reference to FIG. 4B. Control then continues to block 530 where the current view is set to be the next child in z-order, which is the order of the views depth-wise as they appear on the display screen. Control then returns to block 510, as previously described above.

If the determination at block 510 is false, then control continues to block 535 where the visible region of the view is set to be the variable x. Control then continues to block 599 where the function returns.

Figure 6:
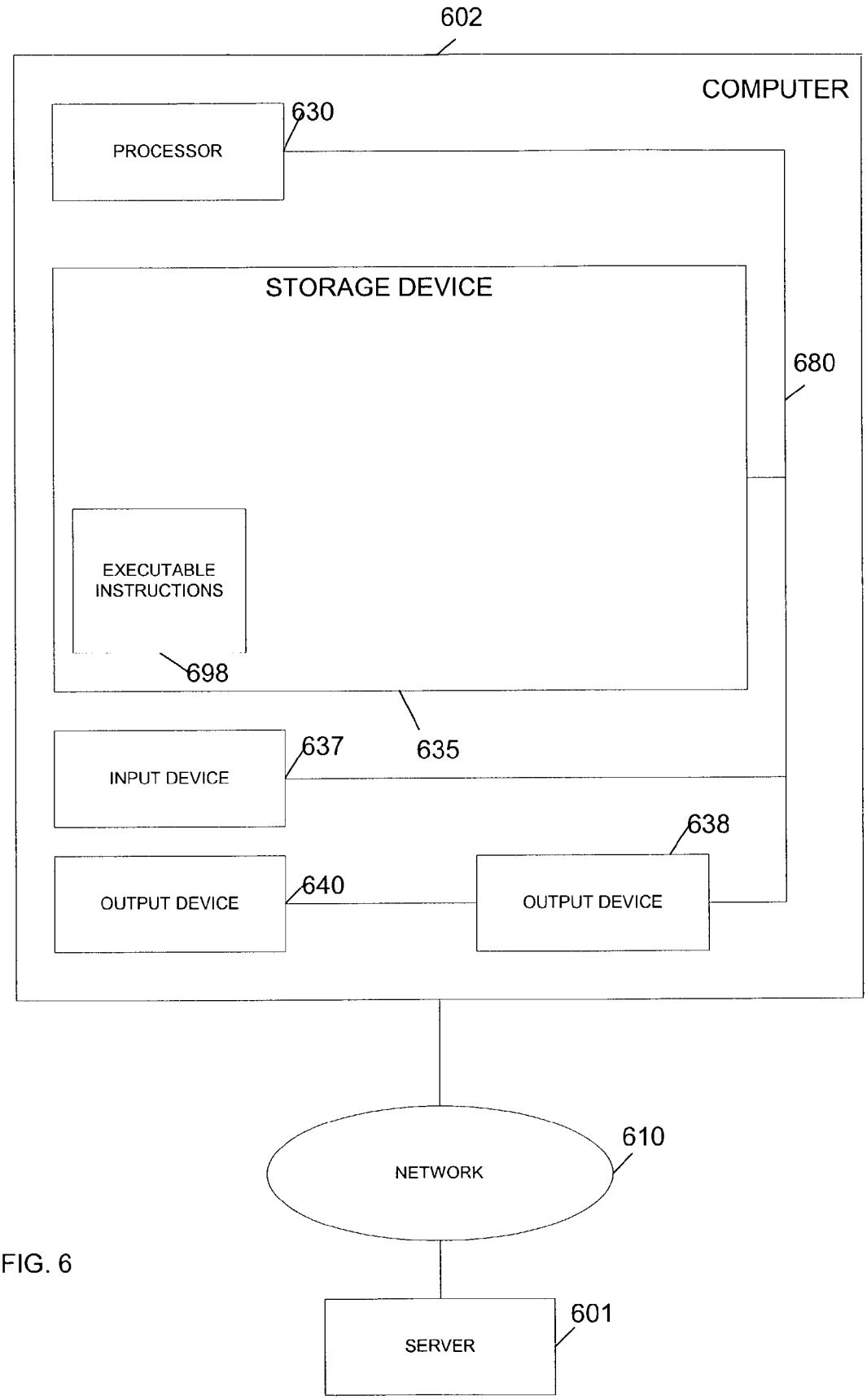
FIG. 6 depicts a block diagram of a system for implementing an embodiment of the invention.

FIG. 6 depicts a detailed block diagram of a system for implementing an embodiment of the invention. Illustrated are server 601 connected to a computer 602 via a network 610. Although one server 601, one computer 602, and one network 610 are shown, in other embodiments any number or combination of them may be present. Although the server 601 and the network 610 are shown, in another embodiment they may not be present.

The computer 602 may include a processor 630, a storage device 635, an input device 637, and an adapter 638, all connected via a bus 680. The adapter 638 may further be connected to an output device 640.

The processor 630 may represent a central processing unit of any type of architecture, such as a CISC (Complex Instruction Set Computing), RISC (Reduced Instruction Set Computing), VLIW (Very Long Instruction Word), or a hybrid architecture, although any appropriate processor may be used. The processor 630 may execute instructions and may include that portion of the computer 602 that controls the operation of the entire computer. Although not depicted in FIG. 6, the processor 630 typically includes a control unit that organizes data and program storage in memory and transfers data and other information between the various parts of the computer 602. The processor 630 may receive input data from the input device 637 and the network 610, may read and store code and data in the storage device 635, may send data to the adapter 638 if present and/or the output device 640, and may send and receive code and/or data to/from the network 610.

Although the computer 602 is shown to contain only a single processor 630 and a single bus 680, the present invention applies equally to computers that may have multiple processors and to computers that may have multiple buses with some or all performing different functions in different ways.

The storage device 635 represents one or more mechanisms for storing data. For example, the storage device 635 may include read only memory (ROM), random access memory (RAM), magnetic disk storage media, optical storage media, flash memory devices, and/or other machine-readable media. In other embodiments, any appropriate type of storage device may be used. Although only one storage device 635 is shown, multiple storage devices and multiple types of storage devices may be present. Further, although the computer 602 is drawn to contain the storage device 635, it may be distributed across other computers, for example on server 601.

The storage device 635 may instructions 698 capable of being executed on the processor 630 to carry out the functions of the present invention, as previously described above with reference to FIGS. 1A-1E, 2A-2F, and 3-5. In another embodiment, some or all of the functions of the present invention may be carried out via hardware in lieu of a processor-based system. Of course, the storage device 635 may also contain additional software and data (not shown).

Although the instructions 698 are shown to be within the storage device 635 in the computer 602, some or all of the instructions 698 may be distributed across other systems, for example on the server 601 and accessed via the network 610.

In another embodiment, the functions of the instructions 698 may be implemented in the adapter 638 or the output device 640, either in software or in hardware.

The input device 637 may be a keyboard, mouse, trackball, touchpad, touchscreen, keypad, microphone, voice recognition device, or any other appropriate mechanism for the user to input data to the computer 602 and to create and/or move views. Although only one input device 637 is shown, in another embodiment any number and type of input devices may be present.

The output device 640 is that part of the computer 602 that communicates output to the user. The output device 640 may be a cathode-ray tube (CRT) based video display well known in the art of computer hardware. But, in other embodiments the output device 640 may be replaced with a liquid crystal display (LCD) based or gas, plasma-based, flat-panel display. In still other embodiments, any appropriate display device may be used suitable for displaying views may be used. Although only one output device 640 is shown, in other embodiments, any number of output devices of different types or of the same type may be present.

The adapter 638 may be a display adapter that accepts data and sends it to the output device 640. In another embodiment, the adapter 638 may not be present.

The bus 680 may represent one or more busses, e.g., PCI, ISA (Industry Standard Architecture), X-Bus, EISA (Extended Industry Standard Architecture), or any other appropriate bus and/or bridge (also called a bus controller).

The computer 602 may be implemented using any suitable hardware and/or software, such as a personal computer or other electronic computing device. Portable computers, laptop or notebook computers, PDAs (Personal Digital Assistants), two-way alphanumeric pagers, keypads, portable telephones, pocket computers, appliances with a computational unit, and mainframe computers are examples of other possible configurations of the computer 602. The hardware and software depicted in FIG. 6 may vary for specific applications and may include more or fewer elements than those depicted. For example, other peripheral devices such as audio adapters, or chip programming devices, such as EPROM (Erasable Programmable Read-Only Memory) programming devices may be used in addition to or in place of the hardware already depicted.

The network 610 may be any suitable network and may support any appropriate protocol suitable for communication between the server 601 and the computer 602. In an embodiment, the network 610 may support wireless communications. In another embodiment, the network 610 may support hard-wired communications, such as a telephone line or cable. In another embodiment, the network 610 may support the Ethernet IEEE 802.3x specification. In another embodiment, the network 610 may be the Internet and may support IP (Internet Protocol). In another embodiment, the network 610 may be a local area network (LAN) or a wide area network (WAN). In another embodiment, the network 610 may be a hotspot service provider network. In another embodiment, the network 610 may be an intranet. In another embodiment, the network 610 may be a GPRS (General Packet Radio Service) network. In another embodiment, the network 610 may be any appropriate cellular data network or cell-based radio network technology. In another embodiment, the network 610 may be an IEEE (Institute of Electrical and Electronics Engineers) 802.11B wireless network. In still another embodiment, the network 610 may be any suitable network or combination of networks. Although one network 610 is shown, in other embodiments any number of networks (of the same or different types) may be present.

As was described in detail above, aspects of an embodiment pertain to specific apparatus and method elements implementable on a computer or other electronic device. In another embodiment, the invention may be implemented as a program product for use with an electronic device. The programs defining the functions of this embodiment may be delivered to an electronic device via a variety of signal-bearing media, which include, but are not limited to:

(1) information permanently stored on a non-rewriteable storage medium, e.g., a read-only memory device attached to or within an electronic device, such as a CD-ROM readable by a CD-ROM drive;

(2) alterable information stored on a rewriteable storage medium, e.g., a hard disk drive or diskette; or (3) information conveyed to an electronic device by a communications medium, such as through a computer or a telephone network, including wireless communications.

Such signal-bearing media, when carrying machine-readable instructions that direct the functions of the present invention, represent embodiments of the present invention.

What is claimed is:

1. A method comprising:

calculating an area on a screen above each of a plurality of views that the each of the plurality of views can be seen through; and determining visible regions of the plurality of views based on the calculated areas on the screen, wherein some of the plurality of views overlap, wherein the determining the visible regions further comprises calculating (((one of the visible-above regions) minus (a structural region of one of the plurality of views)) union ((a visible region of the one of the plurality of views) minus (an opaque region of the one of the plurality of views))).

2. A method comprising:

calculating an area on a screen above each of a plurality of views that the each of the plurality of views can be seen through; and determining visible regions of the plurality of views based on the calculated areas on the screen, wherein some of the plurality of views overlap, wherein the determining the visible regions further comprises subtracting an opaque region of a child view from a visible-above region of one of the plurality of views.

3. An apparatus comprising:

means for calculating an area on a screen above each of a plurality of views that the each of the plurality of views can be seen through; and means for determining visible regions of the plurality of views based on the calculated areas on the screen, wherein some of the plurality of views overlap when displayed, wherein the means for determining the visible regions further comprises means for calculating (((one of the visible-above regions) minus (a structural region of one of the plurality of views)) union ((a visible region of the one of the plurality of views) minus (an opaque region of the one of the plurality of views))).

4. The method of claim 3, wherein the determining the visible regions further comprises:

calculating the visible regions for each child view in z-order.

5. The apparatus of claim 3, wherein at least one of the plurality of views comprises a translucent region and an opaque region.

6. An apparatus comprising:

means for calculating an area on a screen above each of a plurality of views that the each of the plurality of views can be seen through; and means for determining visible regions of the plurality of views based on the calculated areas on the screen, wherein some of the plurality of views overlap when displayed, wherein the means for determining the visible regions further comprises means for subtracting an opaque region of a child view from a visible-above region of one of the plurality of views.

7. The apparatus of claim 6, wherein the means for determining the visible regions further comprises:

means for calculating the visible regions for each child view in z-order.

8. A machine-readable medium encoded with instructions executable by one or more processors, which when executed cause the one or more processors to perform operations comprising:

calculating an area on a screen above each of a plurality of views that the each of the plurality of views can be seen through; and determining visible regions of the plurality of views based on the calculated areas on the screen, wherein some of the plurality of views overlap, wherein the determining the visible regions further comprises calculating (((one of the visible-above regions) minus (a structural region of one of the plurality of views)) union ((a visible region of the one of the plurality of views) minus (an opaque region of the one of the plurality of views))).

9. A machine-readable medium encoded with instructions executable by one or more processors, which when executed cause the one or more processors to perform operations comprising:

calculating an area on a screen above each of a plurality of views that the each of the plurality of views can be seen through; and determining visible regions of the plurality of views based on the calculated areas on the screen, wherein some of the plurality of views overlap, wherein the determining the visible regions further comprises subtracting an opaque region of a child view from a visible-above region of one of the plurality of views.

10. The machine-readable medium of claim 9, wherein the determining the visible regions further comprises:

calculating the visible regions for each child view in z-order.

11. A computer comprising:

a processor; and a storage device, wherein the storage device includes instructions, which when executed by the processor cause the following operations to be performed:

calculating an area on a screen above each of a plurality of views that the each of the plurality of views can be seen through; and determining visible regions of the plurality of views based on the calculated areas on the screen, wherein some of the plurality of views overlap, wherein the determining the visible regions further comprises calculating (((one of the visible-above regions) minus (a structural region of one of the plurality of views)) union ((a visible region of the one of the plurality of views) minus (an opaque region of the one of the plurality of views))).

12. A computer comprising:

a processor; and a storage device, wherein the storage device includes instructions, which when executed by the processor cause the following operations to be performed:

calculating an area on a screen above each of a plurality of views that the each of the plurality of views can be seen through; and determining visible regions of the plurality of views based on the calculated areas on the screen, wherein some of the plurality of views overlap, wherein the determining the visible regions further comprises subtracting an opaque region of a child view from a visible-above region of one of the plurality of views.

13. The computer of claim 12, wherein the determining the visible regions further comprises:

calculating the visible regions for each child view in z-order.

14. The computer of claim 12, wherein the storage device is contained with a display device.

15. The computer of claim 12, wherein the storage device is contained within a display adapter.

* * * * *